US006108945A

United States Patent [19]

Cronk, Jr.

[11] Patent Number: 6,108,945

[45] Date of Patent: Aug. 29, 2000

[54] CLAM BUCKET FOR USE IN PIPELINE PADDING

[76] Inventor: Thomas J. Cronk, Jr., 15 Kingsland Ct., Odessa, Tex. 70762

[21] Appl. No.: 09/329,739

[22] Filed: Jun. 10, 1999

[51] Int. Cl.[7] ..... E02F 5/22

[52] U.S. Cl. ..... 37/142.5; 37/406; 414/726

[58] Field of Search ..... 37/142.5, 340, 37/904, 403, 406, 408, 409, 410, 444, 445, 466, 461; 414/723, 724, 726, 722; 172/254

[56] References Cited

U.S. PATENT DOCUMENTS

| | | | |
|---|---|---|---|
| 4,392,774 | 7/1983 | Thomas, Jr. | 414/726 |
| 4,861,461 | 8/1989 | Utterback | 209/234 |
| 4,864,748 | 9/1989 | Boyer | 37/142.5 |
| 4,912,862 | 4/1990 | Bishop et al. | 37/142.5 |
| 4,955,756 | 9/1990 | Klamar | 405/179 |
| 5,097,610 | 3/1992 | Bishop | 37/142.5 |
| 5,228,735 | 7/1993 | Morrow, Sr. | 294/68.23 |
| 5,261,171 | 11/1993 | Bishop | 37/142.5 |
| 5,335,784 | 8/1994 | Tyler | 209/260 |
| 5,398,430 | 3/1995 | Scott et al. | 37/142.5 |
| 5,479,726 | 1/1996 | Bishop | 37/142.5 |
| 5,493,796 | 2/1996 | Ballew et al. | 37/142.5 |
| 5,540,003 | 7/1996 | Osadchuk | 37/142.5 |
| 5,743,030 | 4/1998 | Sirr | 37/406 |
| 5,771,612 | 6/1998 | Lynch | 37/142.5 |

OTHER PUBLICATIONS

E–Mail Article entitled "Padmore: Construction Padding"; www.padmore.com, Sep. 17, 1999.

*Primary Examiner*—Robert E. Pezzuto

*Attorney, Agent, or Firm*—Howrey Simon Arnold & White LLP; Floyd R. Nation; Carter J. White

[57] ABSTRACT

A clam bucket of the present invention has a first and a second bucket halves, each bucket half includes a first and a second side wall, a bucket back wall, and a bucket connecting plate. At least a portion of each of the two side walls is made of a side wall screen. The bucket back wall is rigidly connected between the first and the second side walls and extends from the bucket top edge to the bucket digging edge. At least a portion of the bucket back wall is composed of a back wall screen. The side wall and back wall screens should be positioned so as to allow padding material to pass through the screen but prohibit the passage of stones through the screen. The bucket connecting plate is rigidly connected to the outside of the bucket back wall and positioned between the first side wall and the second side wall so that connection to a backhoe can be made. A bucket actuating hydraulic cylinder connection collar is also positioned on the bucket connecting plate so that a bucket actuating hydraulic cylinder, which is used to open and closet the two halves in a clam shell like manner, may be pivotably connected to each bucket connecting plate. It is preferred that the bucket connecting plate of at least one of the bucket halves further include a bucket positioning arm having a bucket positioning arm collar. The bucket positioning arm is rigidly connected to the bucket connecting plate so as to permit the connecting of the bucket connecting plate to a crown boom hydraulic cylinder.

9 Claims, 5 Drawing Sheets

CLAM BUCKET FOR USE IN PIPELINE PADDING

BACKGROUND OF THE INVENTION

The laying of underground cables or pipelines is a multi-step process in which a trench is dug along the desired pathway of the pipeline. Typically the earth resulting from the digging of the trench is laid along one side parallel to the trench for latter use as backfill material. The underground cables and pipelines are emplaced by laying the cable or pipeline in the prepared trench and subsequently backfilling the trench.

Because some cables or pipelines are susceptible to damage by stones or other hard objects in the backfill material, a backfill or padding machine such as those described in U.S. Pat. Nos. 4,861,461; 4,912,862; 5,097,610 5,479,726; 5,540,003 are often utilized to separate the stones or other hard material from the relatively fine earth within the backfill material. This is typically done by way of a combination of screens and shakers in which the fine earth material is separated from the larger stones or other hard material. Such devices add to the cost of the pipeline laying process because of the additional equipment and manpower necessary to operate the machines.

Thus to maximize the life of a buried cable or pipeline it is desirable to backfill the trench with fill material that is relatively free of stone or other hard objects. One way to achieve this is to backfill the trench with sand or other suitable fill material brought from a remote source of sand or rock free soil. This approach is can prove to be very expensive, especially in remote areas, due to the time and costs involved in shipping the material to the work site. Further more where a steel pipe is covered with a layer of sand, the filled trench tends to accumulated water in the more porous sand filled trench which in turn leads to the premature corrosion of the pipe. Further the use of a fill material such as sand that is different from the surrounding soil may lead to a loss in the cathodic protection provided for the steel pipe, which also may lead to premature corrosion.

As previously noted, the alternative to is to screen the solid dug from the trench, remove the stones or other hard objects and return the remaining fine earth material to the trench. however, the cost of the additional equipment, time and manpower necessary to operate such equipment may equal or exceed the cost of bringing backfill material such as sand in from a remote source.

U.S. Pat. No. 5,398,430 issued to Scott et al. discloses a bucket and vibratory mechanism attachable to a backhoe. The bucket has a series of adjustable screening blades which alternatively can serve as either the bottom of the bucket or as a sifting mechanism for separating rocks and other hard objects from fine earth materials. While the use of vibratory mechanism to agitate the contents of the bucket is in theory functional, as a practical matter, the process of separation using the disclosed bucket is slow and inefficient.

U.S. Pat. No. 5,493,796 issued to Ballew et al. describes a pipeline padding system in which a backhoe operated bucket is modified so as to serve as a sifting mechanism for backfill material. The device described therein contains a vibrating screen device so that when the bucket is filled with backfill material, the screen is vibrated and fine earth backfill material falls into the pipeline trench. However, because the system utilizes a vibratory mechanism, the use of the described backhoe bucket is slow and inefficient.

U.S. Pat. No 5,743,030 issued to Sirr discloses a front end loader with a dam shell type bucket which functions as a self cleaning particle size separation device. Although described as a clam shell bucket, the bucket described therein is actually a front end loader bucket which has been modified so as to sift backfill material that may be picked up by the bucket. As disclosed therein, a portion of the bucket is pivotably mounted so that material may be scooped up efficiently without premature sifting, the material is sifted, preferably by use of a vibrating mechanism, and then the bucket is cleared of larger debris. As with the other bucket based systems that utilize a vibratory mechanism, the process of separating padding material from stone material is slow and inefficient. Further because the bucket design is a front loader bucket, the tractor will at times need to drive or crawl into the backfill material which further compacts the material and makes the separation process more difficult.

U.S. Pat. No. 5,771,612 issued to Lynch is generally directed to a loader bucket which has been modified so as to include a vibrational sifting system for separating rock from earth fine materials. The device disclosed therein includes a sifting devise that is pivotably mounted such that it can enclose a conventional loader bucket and by way of the vibrating means, sift the larger rock material from the finer earth materials. As with the other bucket based systems that utilize a vibratory mechanism, the process of separating padding material from stone material is slow and inefficient.

Despite the above devices, there remains a need in the pipeline and cable padding industry for new and improved methods and devices for sifting backfill material into rocks and other hard objects and fine earth materials used for padding the pipeline.

SUMMARY OF THE INVENTION

The present invention is generally directed to a clam shell bucket for separating padding material from stones in backfill material. In one illustrative embodiment of the present invention, the clam bucket of the present invention has a first and a second bucket halves. Each bucket half includes a first and a second side wall, a bucket back wall, and a bucket connecting plate. At least a portion of each of the two side walls is made of a side wall screen. The side wall screen is functionally positioned so as to allow padding material to pass through the side wall screen but prohibit the passage of stones through the side wall screen. The two side walls are preferably mirror images of each other, but need not necessarily be identical mirror images.

The bucket back wall has a bucket digging edge, a bucket top edge and a bucket back wall screen. The bucket back wall is rigidly connected between the first and the second side walls and extends from the bucket top edge to the bucket digging edge. At least a portion of the bucket back wall is composed of a back wall screen. The bucket back wall screen is functionally positioned so as to allow padding material to pass through the bucket back wall screen but prohibit the passage of stones through the bucket back wall screen.

The bucket connecting plate is rigidly connected to the outside of the bucket back wall and positioned between the first side wall and the second side wall. One or more bucket connecting plates may be used on each bucket half and should be spaced so that connection to a backhoe can be made. The bucket connecting plate includes a bucket pivot point collar, which is positioned on the bucket connecting plate so that the bucket may be pivotably connected to a bucket pivot point on the end of the crown boom of a backhoe tractor. A bucket actuating hydraulic cylinder connection collar is also positioned on the bucket connecting plate so that a bucket actuating hydraulic cylinder may be pivotably connected to the bucket connecting plate. The role of the bucket actuating hydraulic cylinder is to open and close the two bucket halves in a clam shell manner.

It is preferred that the bucket connecting plate of at least one of the bucket halves further include a bucket positioning arm having a bucket positioning arm collar. The bucket positioning arm is rigidly connected to the bucket connecting plate so as to permit the connecting of the bucket connecting plate to a crown boom hydraulic cylinder. This connection permits the angular positioning of the assembled clam bucket relative to a bucket pivot point which is located at the end of the backhoe crown boom opposite to the tractor.

In one preferred embodiment the clam bucket may further include a bucket support plate which is rigidly connected to the outer surface of the bucket back wall. The function of the bucket support plate is to support the bucket half in an upright position when the bucket half is detached and not in use.

Another preferred embodiment of the present invention is one in which the side wall screens and the back wall screens are made from wire mesh, cross-linked chain, bars or rods spaced in a predetermined manner, or combinations of these such that the padding material is separated from a predetermined size of stone or other hard material that may be present in the backfill material. Such side wall screens and the back wall screens are preferably removable which permits the adjustment of the size of the solid material excluded. In this manner, the screen size may be changed depending upon the padding material needed or the content of the backfill material so as to optimize the padding material used in padding the pipeline or cable.

The present invention also encompasses a method of separating padding material from backfill material which contains both padding material and stones. Such a method includes the steps of: picking up the backfill material in the clam bucket of the present invention; and moving or agitating the full clam bucket to cause the padding material to pass through one or more of the screens in the clam bucket while prohibiting the stones from passing through the screens. It is preferred that the moving or agitating of the full clam bucket be carried out using the hydraulics of the backhoe tractor rather than a vibratory mechanism that is part of the bucket. In this manner padding material can be directly separated above the trench containing the pipeline in a rapid and efficient manner. Alternatively the padding material can be collected on the side of the trench opposite of the backfill material for future use in padding the pipeline.

These and other features of the present invention are more fully set forth in the following description of illustrative embodiments of the invention.

BRIEF DESCRIPTION OF THE DRAWINGS

The following description is presented with reference to the accompanying drawings in which.

DESCRIPTION OF ILLUSTRATIVE EMBODIMENTS

The present invention is directed to a clam shell bucket which may be attached to and used with a backhoe tractor for separating padding material from stones and other solid objects that may be contained within backfill material. As the term is used herein, "padding material" and "earth fines" are used interchangeably and are intended to mean relatively fine earth or sand material that is suitable for padding pipelines or cables. The term "stones", "solid objects" and "stone material" are used interchangeably and mean rocks, stones, concrete chunks, or other solid pieces of material that are not suitable for use as pipeline or cable padding material and may or may not be useful in backfilling a padded pipeline trench.

Figure 1:
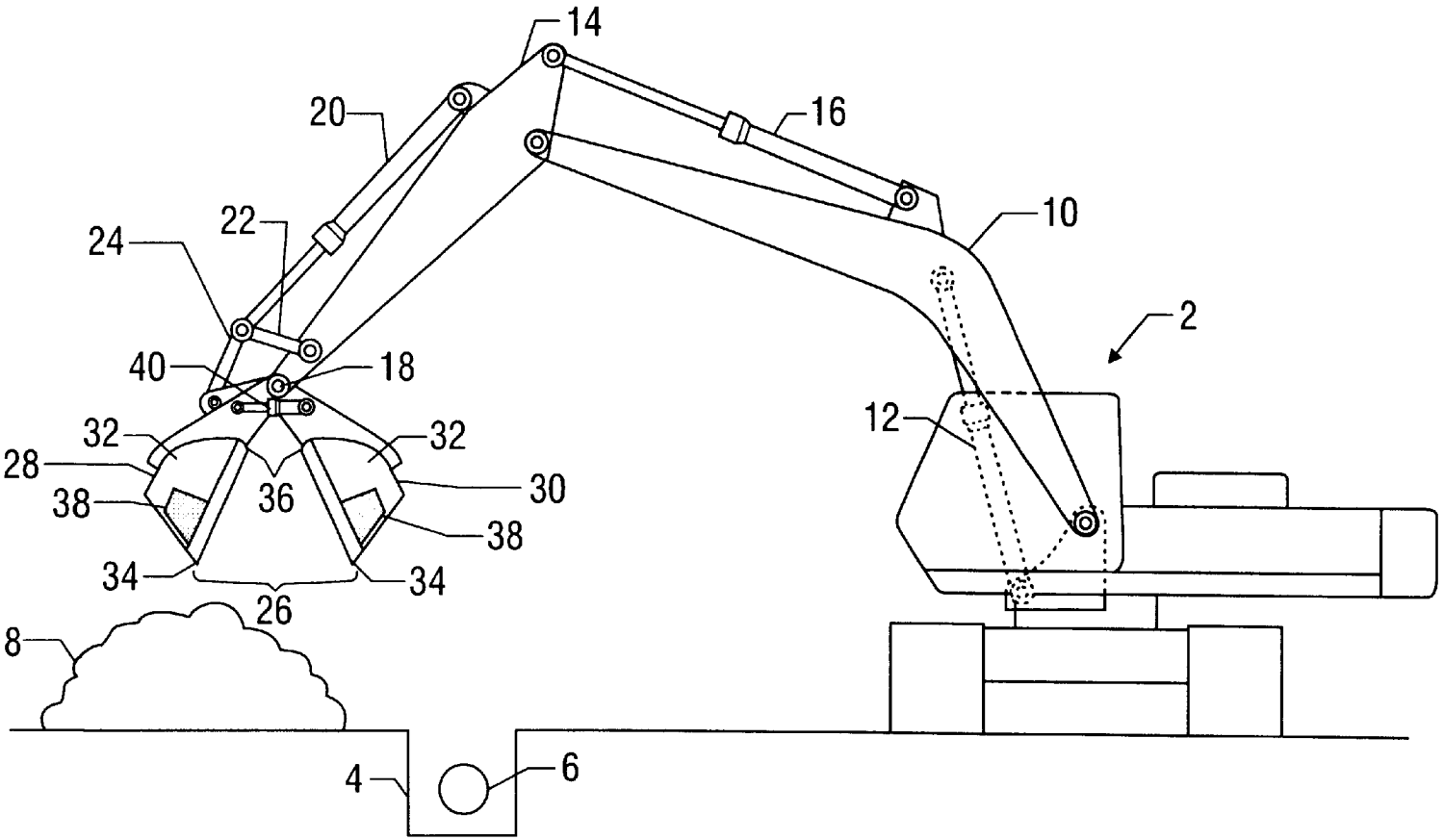
FIG. 1 is an illustrative view of a backhoe operated clam shell bucket of the present invention prior to picking up backfill material from the "non-working" side of a pipeline trench.

As illustrated in FIG. 1 a backhoe tractor 2 is located on the one side, also known as the "working" side, of a pipeline trench 4 into which a pipeline 6 has been laid and is ready for padding. Backfill material 8 is on the opposite side of the trench, also known as "non-working" side of the trench. The backfill material is the material that was excavated from the ground to form the trench and may contain a mixture of dirt, sand, rocks, stones, solid materials such as concrete blocks and the like. The purpose of the present invention is to sift or sieve the backfill material so as to utilize the dirt, sand and other suitable padding materials but substantially preventing the rocks, and other solid objects from hitting or contacting the pipeline. In contrast to several previously disclosed padding material separation mechanisms or buckets, the present invention keeps the tractor on the working side of the trench and thus the tractor need not climb into the backfill material in order to fill the bucket prior to separation of the padding material from the stone material in the backfill material.

The backhoe tractor 2 has pivotably connected to it one end of a backhoe boom 10 the position of which is adjusted by a backhoe boom hydraulic cylinder 12. The operation and control by an operator of a hydraulic cylinder should be familiar to one of ordinary skill in the art. On the other end of the backhoe boom is pivotably connected a crown boom 14. The position of the crown boom is controlled by a boom hydraulic cylinder 16 which is similar to that used to control the backhoe boom. On the end of the crown boom opposite the pivoting connection to the backhoe boom is a bucket pivot point 18 which allows connection of buckets or other tools to the crown boom of the backhoe. Connected to the crown boom is a crown boom hydraulic cylinder 20 which is connected to a pivot arm 22 and connecting arm 24. Conventionally a backhoe bucket is pivotably connected to the bucket pivot point and the position of the backhoe bucket is controlled by the motion of the crown hydraulic cylinder by way of the pivot arm and the connecting arm. Such a conventional arrangement of a backhoe tractor should be understood and appreciated by one of ordinary skill in the art.

The present invention, in contrast to the conventional backhoe bucket, has pivotably connected to the bucket pivot point a clam shell bucket 26 of the present invention. The clams shell bucket of the present invention is composed of a first bucket half 28 and a second bucket half 30 both of which are pivotably mounted to the bucket pivot point 18 in a conventional manner such as the use of a pin and collar connection. The two bucket halves are designed so that they may scoop up a portion of the backfill material and then by motion of the bucket, the padding materials are sieved from the rock material.

The first bucket half and the second bucket half are described in greater detail below. Generally however each bucket is composed of two side plates 32 (one of which is not shown) and a back plate (not shown). The back plate has a digging edge 34 and a top edge 36 and the back plate is rigidly connected to the two side plates such that the back plate extends from the top edge to the digging edge. The back plate may be hemispherical or elliptical in shape or it may be composed or two or more flat plates welded together such that a concave bucket is formed when the two side plates are connected. Both of the sidewalls of each bucket and the bucket back plate are designed such that metal screen 38 forms at least a portion of the walls of the bucket. Alternatively, slats, or bars or rods spaced at a predetermined spacing, may be used or cross-linked chain may be used. Regardless of the actual material used to form the screen, the idea is that the screen portion of the bucket should allow the padding material portion of the backfill material to pass through while substantially preventing rock stones or other solid materials from passing through. Such side wall screens and the back wall screens are preferably removable which permits the adjustment of the size of the solid material excluded. In this manner, the screen size may be changed depending upon the padding material needed or the content of the backfill material so as to optimize the padding material used in padding the pipeline or cable. The clam shell bucket is opened and closed by way of an bucket actuating hydraulic cylinder 40 that is connected to each of the bucket halves by way of a conventional pin and collar connection.

Figure 2:
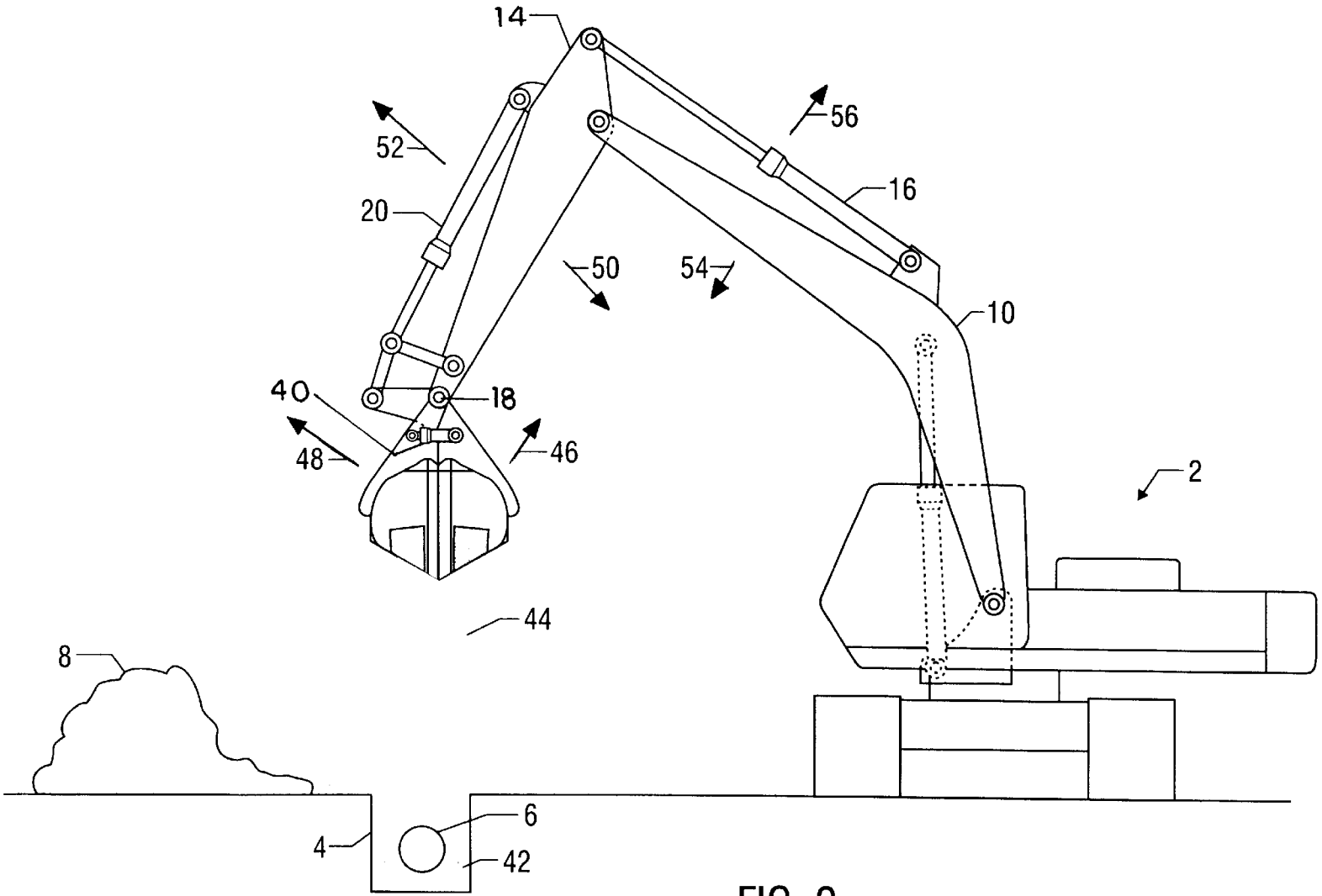
FIG. 2 is an illustrative view of a backhoe operated clam shell bucket of the present invention sifting backfill material.

FIG. 2 depicts the clam bucket of the present invention closed and in the process of separating padding material from stone material contained within the backfill material. It should be noted at this point that for purposes of the present disclosure, the reference numbers assigned to items or objects already discussed or disclosed in earlier figures remain the same in latter figures. Thus, the first bucket half shown for the first time in FIG. 1 and assigned the reference number 28 has retained this same number in the remaining figures.

With this being kept in mind, FIG. 2 depicts a backhoe tractor 2 equipped with the clam shell bucket of the present invention in the process of sieving the backfill material 8 which has been picked up in the clam shell bucket. As shown a portion of padding material 42 has already been deposited in the trench. By shaking or agitating the backfill material picked up by the closed clam shell bucket of the present invention, suitable padding material 44 is separated from rock material in the backfill material. The agitation or shaking of the closed clam shell bucket may be accomplished by a successive back and forth motion of the clam shell bucket about the bucket pivot point as shown by arrows 46 and 48. Alternatively the crown boom can be moved back and forth in successive motions as shown by arrows 50 and 52, such that the contents of the clam bucket are agitated. Yet another method of agitating the contents of the clam bucket is a successive back and forth motion of the backhoe boom as shown by arrows 54 and 56. One of skill in the art should appreciate how this may be accomplished by the operator of the backhoe tractor and such a skilled person should also appreciate the a combination of these motions may be utilized to agitate the contents of the clam shell bucket of the present invention such that the padding materials are substantially separated from the stone materials of the backfill material.

The above described motion and agitation of the bucket contents is in contrast to the prior art in that the hydraulics of the backhoe are utilized as opposed to a bucket mounted vibratory mechanism. Generally, bucket mounted vibratory mechanisms do not have sufficient power to efficiently and rapidly separate padding material from rock material present in the backfill material. Further, by eliminating the bucket mounted vibratory mechanism, the complexity and cost added by such a system is eliminated.

Figure 3:
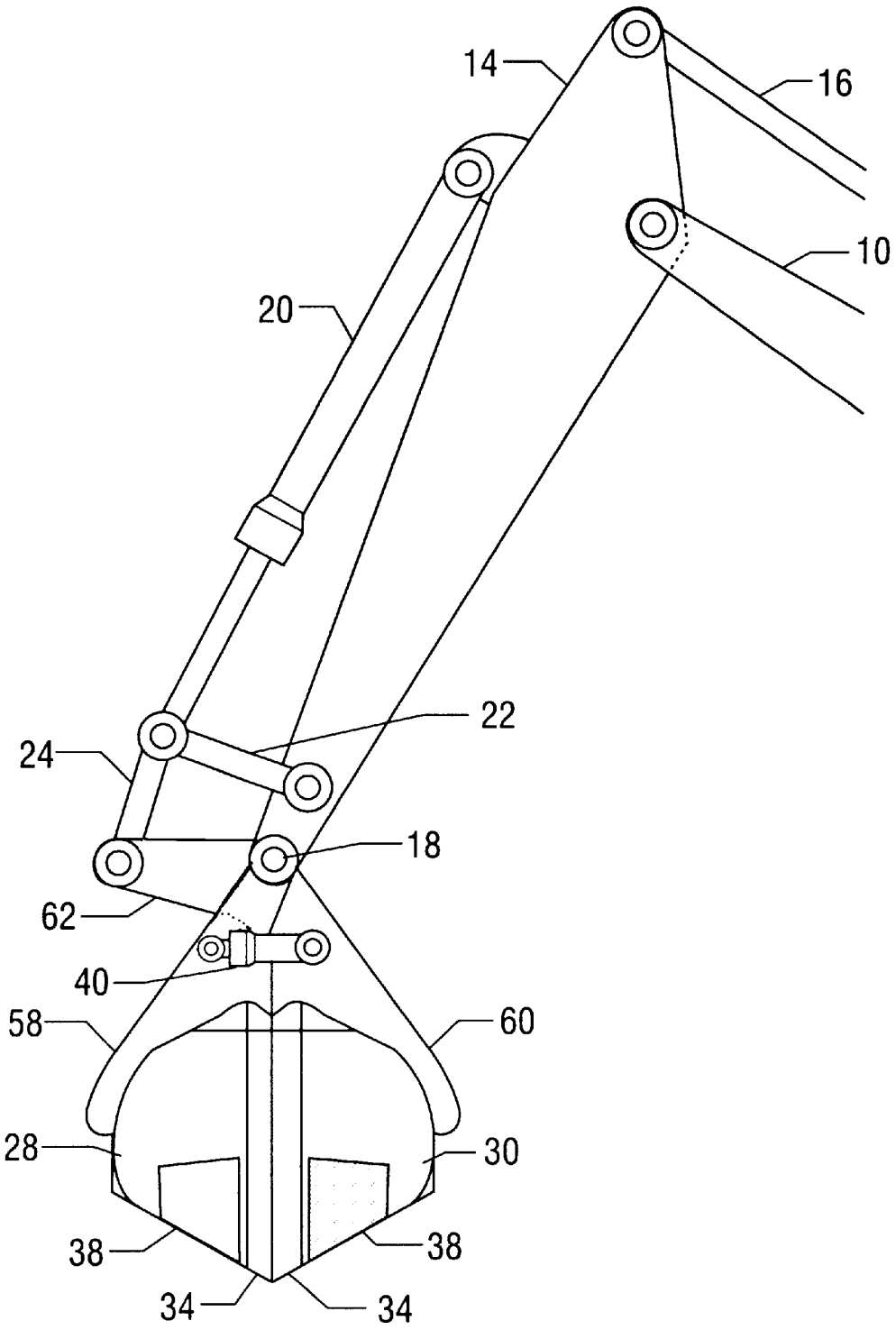
FIG. 3 is a detailed side view drawing of the clam shell bucket of the present invention attached to a crown boom of a backhoe.

A close-up view of the clam shell bucket of the present invention attached to the crown boom of a backhoe tractor is shown in FIG. 3. As shown, the clam bucket is in the closed position with both halves of the clam bucket being held together by the bucket actuating hydraulic cylinder 40. The two bucket halves are pivotably connected to the crown boom 14 by way of the bucket pivot point 18 which in turn is connected to bucket connecting plates 58 and 60 which are rigidly connected to the back plate of each bucket half. Preferably, there is more than one bucket connecting plate for each bucket half and more preferably there are two bucket connecting plates for each bucket half spaced so that they may be connected to the end portion of a conventional backhoe crown boom. The bucket actuating hydraulic cylinder is functionally connected to the bucket connecting plate of each bucket. As previously noted, the role of the bucket actuating hydraulic cylinder is to open and close the two halves of the clam bucket in a clam shell type manner that give this type of bucket its name. It should be noticed by one of skill in the art that the bucket connecting plate for the first bucket half 58 and the second bucket half 60 are not mirror images of each other as the buckets generally are. Rather the second bucket half connecting plate 60 has rigidly fixed to it a bucket positioning arm 62. The bucket positioning arm is in turn connected to a connecting arm 24 and pivot arm 22, such that the motion of the crown hydraulic cylinder 20 causes the bucket to pivot about the bucket pivot point 18. The connection of the crown boom hydraulic cylinder to the bucket positioning arm is conventional to the connection utilized to connect and control the position of a backhoe bucket.

Figure 4B:
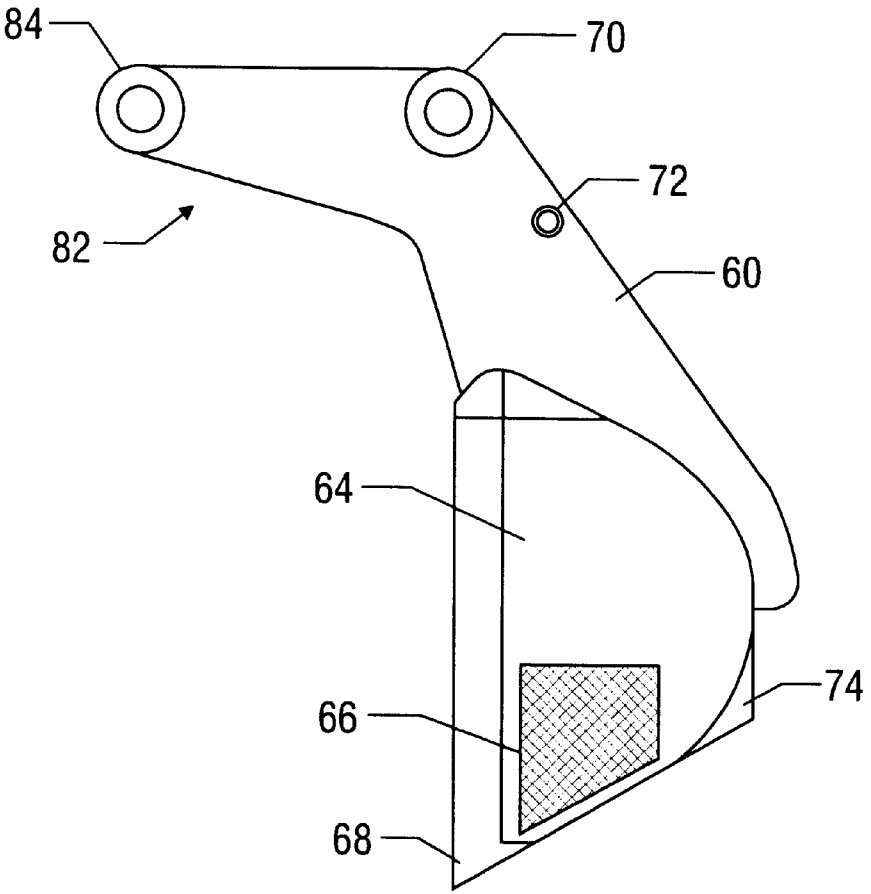
FIGS. 4A and 4B are a detailed side view drawings of the clam shell bucket of the present invention.
Figure 4A:
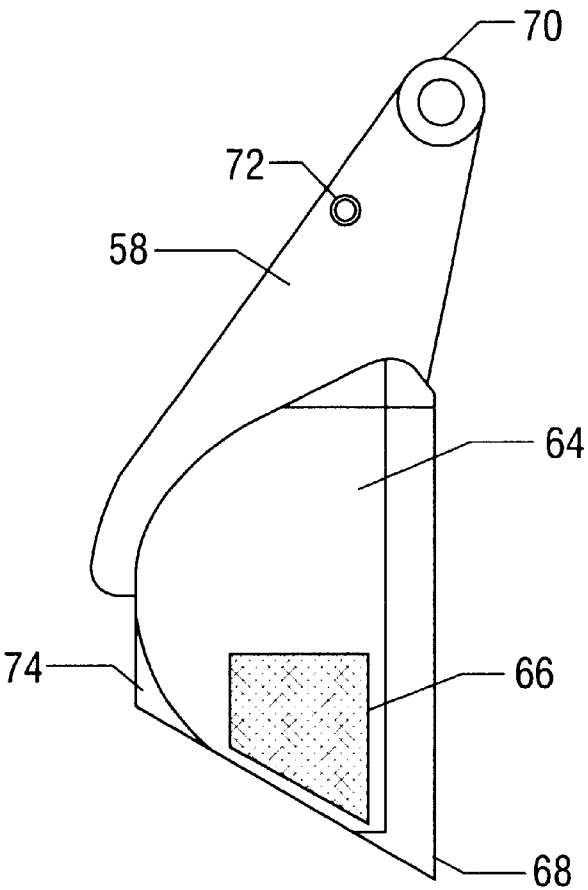

The two halves of the clam shell bucket of the present invention are shown in FIGS. 4A and 4B detached from the crown boom of the backhoe tractor. Turning to the first bucket half shown in FIG. 4A it can be seen that the first bucket half is composed of a first side wall (64) and a second side wall (not shown), a first bucket back wall (not shown), a first bucket connecting plate 58.

The first side wall is constructed of conventional materials such as steel or other suitable metal and is formed such that at least a portion of the first side wall is made of metal mesh or similar such materials as previously described above thus forming the first side wall screen 66. The first side wall screen should be functionally positioned so as to allow padding material to pass through the first side wall screen but prohibit the passage of stones through the first side wall screen. As shown, the side wall screen preferably is located in the lower portions of the side wall and is about ¼ to about ⅓ of the area of the plate. However, the portion of the side plate that is the sidewall screen may be optimized by trial and error experimentation and will depend upon the materials used to form the screen itself.

The second side wall (not shown), like the first side wall, has at least a portion of the side wall that is formed by a second side wall screen. The second side wall screen should be functionally positioned so as to allow padding material to pass through the second side wall screen but prohibit the passage of stones through the second side wall screen.

The first bucket back wall (not shown) has a first bucket digging edge 68 and a first bucket top edge (not shown) between which the first bucket back wall is rigidly connected. The first bucket digging edge may be the actual edge of the first bucket back wall or it may be covered with a hardened steel or other metal alloy that is more resistant to the abrasive contact with the backfill material. The first bucket back wall is rigidly connected between the first and the second side walls and extends from the first bucket top edge to the first bucket digging edge. In the present embodiment, the first bucket back wall includes: at least one first bucket back wall screen (not shown). The first bucket back wall screen forms at least a portion of the back wall and is functionally positioned so as to allow padding material to pass through the first bucket back wall screen but prohibit the passage of stones through the first bucket back wall screen.

As previously disclosed, one or more first bucket connecting plates 58 may be rigidly connected to the first bucket back wall and positioned between the first side wall and the second side wall. The first bucket connecting plate includes a first bucket pivot point collar 70 which is positioned on the first bucket connecting plate so that the first bucket may be pivotably connected to the second bucket half. The first bucket connecting plate further includes a first bucket actuating hydraulic cylinder connection collar 72 which is positioned on the first bucket connecting plate so that a bucket actuating hydraulic cylinder may be pivotably connected to the first bucket connecting plate.

In the preferred illustrative embodiment shown, a bucket support plate 74 is also rigidly connected to the outer surface of the first bucket backwall. The bucket support plate is positioned such that bucket half may be disconnected from the crown boom and placed on the ground or else where without the bucket half rolling into an awkward position for reinstallation. Thus, the bucket support plate is positioned on the back wall so as to support the bucket half in an upright position when the bucket half is detached from the backhoe.

Figure 5:
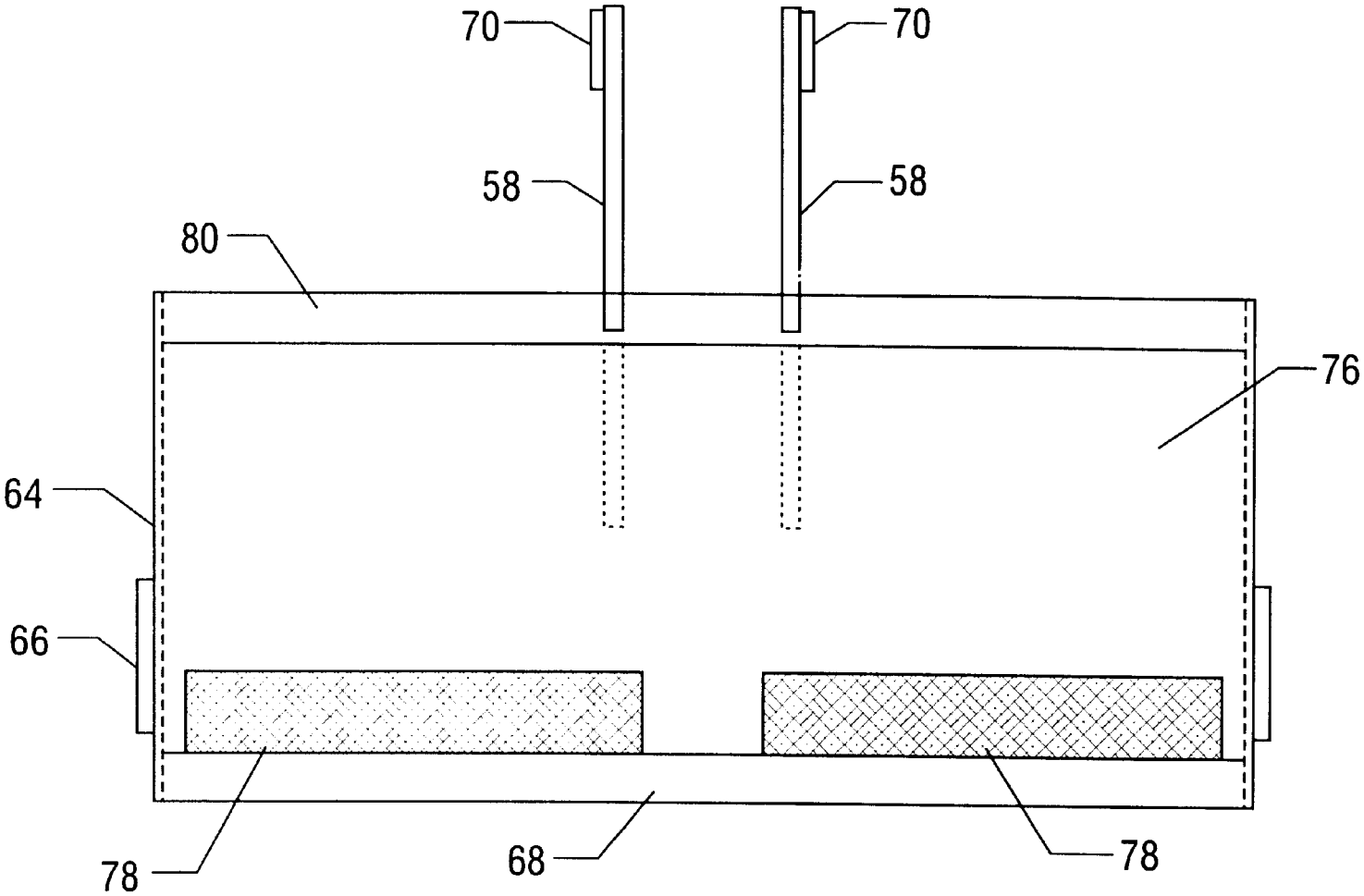
FIG. 5 is a detailed front view drawings of the clam shell bucket of the present invention.

FIG. 5 shows the first bucket half as seen from a perspective looking into the bucket, that is to say the concave first bucket back plate 76 is curving towards the viewer. As shown one can see that there is more that back wall screens 78 evenly spaced in the lower portion of the back wall. Also visible is the top plate 80 portion of the first bucket half. The top plate is welded or rigidly connected to the top edge of the first bucket back plate. The role of the top plate is to help contain the backfill material within the closed clam shell bucket during the agitation process. As is preferred, more that one first bucket connecting plates are rigidly connected to the first bucket backwall. The bucket pivot point collar is shown as well.

FIG. 4B illustrates the second bucket half which as previously noted is generally, but not necessarily, a mirror image of the first bucket half provided that the second bucket connecting plate is different in the following respects. The second bucket connecting plate is similar to the first bucket connecting plate in that is rigidly fixed to the second bucket back wall between the third and fourth sidewalls respectively. As with the first bucket connecting plate, more than one second bucket connecting plate may be utilized in order to connect the second bucket to the bucket pivot point on the end of a conventional crown boom. The point of difference with the first bucket connecting plate is that the second bucket connecting plate has rigidly fixed to it a bucket positioning arm 82. The purpose of the bucket positioning arm is to extend the bucket positioning plate so that the clam bucket of the present invention may be conventionally connected to crown boom hydraulic cylinder by way of the pivot arm and connecting arm. This connection allows the motion of the crown boom hydraulic cylinder to control the angular position of the clam bucket relative to the crown boom and the bucket pivot point. So that the connection to the connecting arm is conventional, the bucket connecting arm has functionally positioned on it a bucket positioning arm collar 84.

One of skill in the art, when comparing the preferred illustrative embodiment of the present invention to those in the prior art should note the absence of a bucket mounted vibratory mechanism to agitate the contents of the bucket. It has been found that such bucket mounted vibratory mechanisms are generally under-powered and not fully sufficient to cause sufficient agitation of the contents of the bucket to efficiently and rapidly separate padding materials from stone material present in the backfill material. Further, such bucket mounted vibratory mechanisms further complicate the day to day use of the prior art buckets and needlessly increase the complexity of the bucket system. Thus one aspect of the present illustrative embodiment is the conspicuous absence of a bucket mounted vibratory mechanism. As previously disclosed herein, it is preferred that the contents of the clam shell bucket of the present invention be agitated by the back and forth motion of the hydraulic systems already present on the backhoe tractor. Thus, the successive back and forth motion of the backhoe boom, the crown boom, the bucket itself or a rotational motion of the tractor itself may be used to agitate the contents of the clam bucket of the present invention such that suitable padding material is separated from the stone material present in the backfill material.

In view of the above disclosure one of ordinary skill in the art should understand that the present invention encompasses a clam shell bucket for separating padding material from stones in backfill material. In one illustrative embodiment of the present invention, the clam bucket of the present invention has a first and a second bucket halves. Each bucket half includes a first and a second side wall, a bucket back wall, and a bucket connecting plate. At least a portion of each of the two side walls is made of a side wall screen. The side wall screen is functionally positioned so as to allow padding material to pass through the side wall screen but prohibit the passage of stones through the side wall screen. The two side walls are preferably mirror images of each other, but need not necessarily be true.

The bucket back wall has a bucket digging edge, a bucket top edge and a bucket back wall screen. The bucket back wall is rigidly connected between the first and the second side walls and extends from the bucket top edge to the bucket digging edge. At least a portion of the bucket back wall is composed of a back wall screen. The bucket back wall screen is functionally positioned so as to allow padding material to pass through the bucket back wall screen but prohibit the passage of stones through the bucket back wall screen.

The bucket connecting plate is rigidly connected to the outside of the bucket back wall and is positioned between the first side wall and the second side wall. One or more bucket connecting plates may be used on each bucket half and should be spaced so that a connection to a backhoe can be made. The bucket connecting plate includes a bucket pivot point collar, which is positioned on the bucket connecting plate so that the bucket may be pivotably connected to a bucket pivot point on the end of the crown boom of a backhoe tractor. A bucket actuating hydraulic cylinder connection collar is also positioned on the bucket connecting plate so that a bucket actuating hydraulic cylinder may be pivotably connected to the bucket connecting plate. The role of the bucket actuating hydraulic cylinder is to open and close the two bucket halves in a clam shell manner.

It is preferred that the bucket connecting plate of at least one of the bucket halves further include a bucket positioning arm having a bucket positioning arm collar. The bucket positioning arm is rigidly connected to the bucket connecting plate so as to permit the connecting of the bucket connecting plate to a crown boom hydraulic cylinder. This connection permits the angular positioning of the assembled clam bucket relative to a bucket pivot point which is located at the end of the backhoe crown boom opposite to the tractor.

In one preferred embodiment the clam bucket may further include a bucket support plate which is rigidly connected to the outer surface of the bucket back wall. The function of the bucket support plate is to support the bucket half in an upright position when the bucket half is detached and not in use.

Another preferred embodiment of the present invention is one in which the side wall screens and the back wall screens are made from wire mesh, cross-linked chain, bars or rods spaced in a predetermined manner, or combinations of these such that the padding material is separated from a predetermined size of stone or other hard material that may be present in the backfill material. Such side wall screens and the back wall screens are preferably removable which permits the adjustment of the size of the solid material excluded. In this manner, the screen size may be changed depending upon the padding material needed or the content of the backfill material so as to optimize the padding material used in padding the pipeline or cable.

One of ordinary skill in the art should also appreciate that the present invention also includes a clam shell bucket for separating padding material from stones in backfill material. Such an illustrative clam bucket is composed of a first bucket half which includes: a first and a second side wall, a first bucket back wall, and a first bucket connecting plate. The first side wall is constituted such that at least a portion of the first side wall is made of screen or similar such materials as previously described above thus forming the first side wall screen. The first side wall screen should be functionally positioned so as to allow padding material to pass through the first side wall screen but prohibit the passage of stones through the first side wall screen.

The second side wall, like the first side wall, has a portion of the side wall that forms a second side wall screen. The second side wall screen is made such that it is at least a portion of the second side wall and is functionally positioned so as to allow padding material to pass through the second side wall screen but prohibit the passage of stones through the second side wall screen.

The first bucket back wall has a first bucket digging edge and a first bucket top edge between which the first bucket back wall is rigidly connected. The first bucket back wall is also rigidly connected between the first and the second side walls and extending from the first bucket top edge to the first bucket digging edge. In the present embodiment, the first bucket back wall includes at least one first bucket back wall screen. The first bucket back wall screen forms at least a portion of the back wall and is functionally positioned so as to allow padding material to pass through the first bucket back wall screen but prohibit the passage of stones through the first bucket back wall screen.

One or more first bucket connecting plates may be rigidly connected to the first bucket back wall and positioned between the first side wall and the second side wall. The first bucket connecting plate includes a first bucket pivot point collar which is positioned on the first bucket connecting plate so that the first bucket may be pivotably connected to the second bucket half. The first bucket connecting plate further includes a first bucket actuating hydraulic cylinder connection collar which is positioned on the first bucket connecting plate so that a bucket actuating hydraulic cylinder may be pivotably connected to the first bucket connecting plate.

The second bucket half, is generally similar to the first bucket half, but includes: a third and a fourth side wall, a second bucket back wall and a second bucket connecting plate. The third and fourth side walls are analogous to the first and second side walls in that the third side wall screen forms at least a portion of the third side wall and the third side wall screen is functionally positioned so as to allow padding material to pass through the third side wall screen but prohibit the passage of stones through the third side wall screen while the fourth side wall screen forms at least a portion of the fourth side wall and is functionally positioned so as to allow padding material to pass through the fourth side wall screen but prohibit the passage of stones through the fourth side wall screen.

The second bucket back wall has a second bucket digging edge and a second bucket top edge and the second bucket back wall is rigidly connected between the third and the fourth side walls and extends from the second bucket top edge to the second bucket digging edge. The second bucket back wall includes a second bucket back wall screen, the second bucket back wall screen forming at least a portion of the second bucket back wall and functionally positioned so as to allow padding material to pass through the second bucket back wall screen but prohibit the passage of stones through the second bucket back wall screen.

The second bucket connecting plate is similar to the first bucket connecting plate in that the second bucket connecting plate is rigidly connected to the back wall and positioned between the third side wall and the fourth side wall. However, the second bucket connecting plate has, in addition to a second bucket pivot point collar, which is positioned on the second bucket connecting plate so that the second bucket may be pivotably connected to the first bucket half; and a second bucket actuating hydraulic cylinder connection collar being positioned on the second bucket connecting plate so that the bucket actuating hydraulic cylinder may be pivotably connected to the second bucket connecting plate, a bucket positioning arm having a bucket positioning arm collar. The bucket positioning arm is rigidly connected to the second bucket connecting plate so as to permit the connecting of the second bucket connecting plate to a crown boom hydraulic cylinder and to permit the angular positioning of the assembled clam bucket relative to a bucket pivot point.

Optionally, the above first and second bucket halves may respectively have a bucket support plates which are rigidly connected to the outer surface of the bucket back wall so as to support the bucket half in an upright position when the first bucket half is detached from the backhoe.

The present invention also encompasses the use of the above described clam bucket of the separation of padding material from backfill material containing padding material and stones. Such a method is preferably carried out soon after the pipeline or cable has been laid into the trench. However, the method may also be carried out prior to the laying of the pipeline or cable in the trench. In such a situation, the padding material can be piled on the working side of the trench next to the backfill material or it may be placed in some other location for use latter. Regardless of the relative time that the method is carried out, the method generally includes the steps of picking up the backfill material in the clam bucket of the present invention and then moving or agitating the full clam bucket so as to cause the padding material to pass through one or more of the screens in the clam bucket. When the clam bucket contains a minimal amount of padding material such that further agitation or motion does not cause the remaining padding material to fall through the screens, the contents of the clam bucket should comprise mostly of stone or other hard objects which can be discarded or saved for later use in back filling the trench.

The moving or agitation process may be carried out in a number of different manners so long as the padding material is separated from the stone material. In one preferred embodiment the clam bucket is shaken up and down by rapidly moving back and forth the crown boom hydraulic cylinder and thus rapidly pivoting the clam bucket back and forth about the bucket pivot point. Alternatively, the boom hydraulic cylinder can be rapidly moved back and forth so that the crown boom, and thus the attached clam bucket moves back and forth agitating the contents of the clam bucket. Another method of moving or agitating the contents of the clam bucket is for the main hydraulic cylinder for the backhoe boom to be rapidly moved up and down. Other methods of shaking the clam bucket and the contents of the clam bucket will be apparent to one of skill in the art. Regardless of the exact method used to move or agitate the clam bucket, the motion should cause the backfill material contained within the clam bucket to move or be agitated, such that the padding materials pass through the clam bucket screens and the stone material remains in the clam bucket.

While the structures and methods of the present invention have been described in terms of preferred embodiments, it will be apparent to those of skill in the art that variations may be applied to the what has been described herein without departing from the concept and scope of the invention. All such similar substitutes and modifications apparent to those skilled in the art are deemed to be within the scope and concept of the invention as it is set out in the following claims.

What is claimed is:

1. A clam shell bucket including:

a first and second bucket halves, each bucket half including:

a first and a second side wall a first side wall screen, the first side wall screen constituting at least a portion of the first side wall and functionally positioned so as to allow padding material to pass through the first side wall screen but prohibit the passage of stones through the first side wall screen a second side wall screen, the second side wall screen constituting at least a portion of the second side wall and functionally positioned so as to allow padding material to pass through the second side wall screen but prohibit the passage of stones through the second side wall screen;

a bucket back wall, the bucket back wall having:

a bucket digging edge a bucket top edge and the bucket back wall being rigidly connected between the first and the second side walls and extending from the bucket top edge to the bucket digging edge and wherein the bucket back wall includes:

a bucket back wall screen, the bucket back wall screen constituting at least a portion of the back wall and functionally positioned so as to allow padding material to pass through the bucket back wall screen but prohibit the passage of stones through the bucket back wall screen;

a bucket connecting plate, the bucket connecting plate being rigidly connected to the bucket back wall and positioned between the first side wall and the second side wall; the bucket connecting plate having:

a bucket pivot point collar, the bucket pivot point collar being positioned on the bucket connecting plate so that the bucket may be pivotably connected to a bucket pivot point; and a bucket actuating hydraulic cylinder connection collar being positioned on the bucket connecting plate so that a bucket actuating hydraulic cylinder may be pivotably connected to the bucket connecting plate.

2. The clam bucket of claim 1, wherein the bucket connecting plate of the second bucket half further includes a bucket positioning arm having a bucket positioning arm collar, the bucket positioning arm being rigidly connected to the bucket connecting plate of the second bucket half so as to permit the connecting of the second bucket connecting plate to a crown boom hydraulic cylinder and to permit the angular positioning of the assembled clam bucket relative to a bucket pivot point.

3. The clam bucket of claim 1 further including:

a bucket top plate, the bucket top plate being rigidly connected to the top edge of the bucket back plate and to the first side wall and the second side wall.

4. The clam bucket of claim 1, wherein the bucket back wall has a outer surface, the clam bucket further including:

a bucket support plate, the bucket support plate being rigidly connected to the outer surface of the bucket back wall so as to support the bucket half in an upright position when the bucket half is detached and not in use.

5. The clam bucket of claim 1, wherein side wall screens and the back wall screens are made from wire mesh, cross-linked chain, bars or rods spaced in a predetermined manner, or combinations thereof.

6. A method of separating padding material from backfill material, the backfill material containing padding material and stones, the method comprising:

picking up the backfill material in the clam bucket of claim 1 to give a clam bucket containing the backfill material;

moving the clam bucket containing the backfill material so as to cause the padding material to pass through one or more screens in the clam bucket while prohibiting the stones from passing through the screens.

7. A clam shell bucket for separating padding material from stones in backfill material, the clam shell bucket including a first bucket half and a second bucket half, the first bucket half including:

a first and a second side wall a first side wall screen, the first side wall screen constituting at least a portion of the first side wall and functionally positioned so as to allow padding material to pass through the first side wall screen but prohibit the passage of stones through the first side wall screen a second side wall screen, the second side wall screen constituting at least a portion of the second side wall and functionally positioned so as to allow padding material to pass through the second side wall screen but prohibit the passage of stones through the second side wall screen;

a first bucket back wall, the first bucket back wall having:

a first bucket digging edge and a first bucket top edge the first bucket back wall being rigidly connected between the first and the second side walls and extending from the first bucket top edge to the first bucket digging edge; and wherein the first bucket back wall includes:

a first bucket back wall screen, the first bucket back wall screen constituting at least a portion of the back wall and functionally positioned so as to allow padding material to pass through the first bucket back wall screen but prohibit the passage of stones through the first bucket back wall screen;

a first bucket connecting plate, the first bucket connecting plate being rigidly connected to the back wall and positioned between the first side wall and the second side wall; the first bucket connecting plate having:

a first bucket pivot point collar, the first bucket pivot point collar being positioned on the first bucket connecting plate so that the first bucket may be pivotably connected to the second bucket half; and a first bucket actuating hydraulic cylinder connection collar being positioned on the first bucket connecting plate so that a bucket actuating hydraulic cylinder may be pivotably connected to the first bucket connecting plate;

the second bucket half including:

a third and a fourth side wall a third side wall screen, the third side wall screen constituting at least a portion of the third side wall and functionally positioned so as to allow padding material to pass through the third side wall screen but prohibit the passage of stones through the third side wall screen a fourth side wall screen, the fourth side wall screen constituting at least a portion of the fourth side wall and functionally positioned so as to allow padding material to pass through the fourth side wall screen but prohibit the passage of stones through the fourth side wall screen;

a second bucket back wall, the second bucket back wall having:

a second bucket digging edge and a second bucket top edge the second bucket back wall being rigidly connected between the third and the fourth side walls and extending from the second bucket top edge to the second bucket digging edge; and wherein the second bucket back wall includes:

a second bucket back wall screen, the second bucket back wall screen constituting at least a portion of the second bucket back wall and functionally positioned so as to allow padding material to pass through the second bucket back wall screen but prohibit the passage of stones through the second bucket back wall screen;

a second bucket connecting plate, the second bucket connecting plate being rigidly connected to the back wall and positioned between the third side wall and the fourth side wall; the second bucket connecting plate having:

a second bucket pivot point collar, the second bucket pivot point collar being positioned on the second bucket connecting plate so that the second bucket may be pivotably connected to the first bucket half; and a second bucket actuating hydraulic cylinder connection collar being positioned on the second bucket connecting plate so that the bucket actuating hydraulic cylinder may be pivotably connected to the second bucket connecting plate;

a bucket positioning arm having a bucket positioning arm collar, the bucket positioning arm being rigidly connected to the second bucket connecting plate so as to permit the connecting of the second bucket connecting plate to a crown boom hydraulic cylinder and to permit the angular positioning of the assembled clam bucket relative to a bucket pivot point.

8. The clam bucket of claim 7 further including:

a first bucket top plate, the first bucket top plate being rigidly connected to the top edge of the first bucket back plate and to the first side wall and the second side wall; and a second bucket top plate, the second bucket top plate being rigidly connected to the top edge of the second bucket back plate and to the third side wall and the fourth side wall.

9. The clam bucket of claim 7, wherein the first bucket back wall and the second bucket back wall have outer surfaces, the clam bucket further including:

a first bucket support plate, the first bucket support plate being rigidly connected to the outer surface of the first bucket back wall so as to support the first bucket half in an upright position when the first bucket half is detached from the backhoe a second bucket support plate, the second bucket support plate being rigidly connected to the outer surface of the second bucket back wall so as to support the second bucket half in an upright position when the second bucket half is detached from the backhoe.

* * * * *